US010035626B2

(12) United States Patent
Kishore Kumar et al.

(10) Patent No.: US 10,035,626 B2
(45) Date of Patent: Jul. 31, 2018

(54) PRESSURE-RELEASE SEALING CAP

(71) Applicant: SUNDRAM FASTENERS LIMITED, Chennai, Tamilnadu (IN)

(72) Inventors: Otra Narasimhalu Kishore Kumar, Chennai (IN); Gajendran Parthasaarathy, Chennai (IN); Ilu Manohar Reddy, Chennai (IN); Narayanaswamy Kumaresan, Chennai (IN)

(73) Assignee: SUNDRAM FASTENERS LIMITED, Chennai (IN)

( * ) Notice: Subject to any disclaimer, the term of this patent is extended or adjusted under 35 U.S.C. 154(b) by 0 days.

(21) Appl. No.: 15/308,775

(22) PCT Filed: May 5, 2015

(86) PCT No.: PCT/IN2015/000192

§ 371 (c)(1),
(2) Date: Nov. 3, 2016

(87) PCT Pub. No.: WO2015/170337

PCT Pub. Date: Nov. 12, 2015

(65) Prior Publication Data

US 2017/0183131 A1 Jun. 29, 2017

(30) Foreign Application Priority Data

May 5, 2014 (IN) ..... 2231/CHE/2014

(51) Int. Cl.
*B65D 41/10* (2006.01)
*B65D 51/16* (2006.01)

(52) U.S. Cl.
CPC ..... *B65D 41/10* (2013.01); *B65D 51/16* (2013.01)

(58) Field of Classification Search
CPC ..... B65D 41/10; B65D 41/105; B65D 41/02; B65D 41/04; B65D 41/06; B65D 45/025;
(Continued)

(56) References Cited

U.S. PATENT DOCUMENTS 2,591,562 A 4/1952 Levell
2,918,191 A * 12/1959 Pipes ..... F01P 11/0238 220/301

(Continued)

OTHER PUBLICATIONS

International Search Report dated Oct. 22, 2015 in corresponding International Application No. PCT/IN2015/000192.

*Primary Examiner* — Robert J Hicks
(74) *Attorney, Agent, or Firm* — Staas & Halsey LLP

(57) ABSTRACT

A pressure-release sealing cap for a reservoir includes a rotatable platform with a ramp connected to a rotatable enclosure. A movable plunger is connected to a movable pressure-release member with a guide stud and a valve. The guide stud disposed is on the ramp between first and second reference portions of the ramp, while the sealing cap is installed on the reservoir and the guide stud disposed to rotate on the ramp on rotation of the enclosure to lift the valve, to release the excess pressure while concurrently removing the sealing cap from the reservoir. The pressure-releasing member is actuated indirectly to release excess pressure from the reservoir, in a controlled and gradual manner.

8 Claims, 5 Drawing Sheets

(58) Field of Classification Search
CPC ..... B65D 51/16; B65D 51/26; B65D 39/00; B65D 51/1661; B65D 51/1644; B65D 51/1633; B65D 51/1683; B65D 47/248; B65D 47/249; B65D 47/24; B60K 15/0406; F01P 11/0238; F01P 11/0209
USPC ..... 220/302, 301, 293, 288, 562, 203.01, 220/203.04, 203.11, 203.13, 203.24, 220/203.27–203.29; 215/329, 316, 364, 215/356, 355, 315, 313, 311, 307
See application file for complete search history.

(56) References Cited

U.S. PATENT DOCUMENTS

| | | | | |
|---|---|---|---|---|
| 3,128,000 | A * | 4/1964 | Haberle | B65D 47/2037 215/270 |
| 3,381,846 | A * | 5/1968 | Lee | F01P 11/0238 220/203.04 |
| 4,676,390 | A | 6/1987 | Harris | |
| 4,887,733 | A | 12/1989 | Harris | |
| 5,108,001 | A | 4/1992 | Harris | |
| 7,114,470 | B2 | 10/2006 | Ramanathan et al. | |
| 7,353,965 | B2 * | 4/2008 | Reutter | B60K 15/0406 220/203.28 |
| 7,380,681 | B2 | 6/2008 | Reutter | |
| 7,654,403 | B2 | 2/2010 | DeCapua et al. | |
| 8,353,418 | B2 | 1/2013 | Bork | |
| 2004/0056034 | A1 * | 3/2004 | Reutter | F01P 11/0238 220/303 |
| 2011/0198349 | A1 * | 8/2011 | Lane | A47G 19/2272 220/203.04 |

* cited by examiner

PRESSURE-RELEASE SEALING CAP

CROSS-REFERENCE TO RELATED APPLICATION

This application is a U.S. national stage application, which claims the benefit under 35 USC § 371 of PCT International Patent Application No. PCT/IN2015/000192 filed May 5, 2015 which claims foreign priority benefit under 35 USC § 119 of Indian Patent Application No. 2231/CHE/2014, filed on May 5, 2014, the entire contents of which are incorporated herein by reference.

TECHNICAL FIELD

The present invention relates to a pressure-release sealing cap to close a reservoir of radiator or a surge tank, of an automotive or a power generator, to release excessive pressure conditions prevailing inside the reservoir during operations. The present invention particularly relates to a pressure-release sealing cap with a pressure-release member, configured to be actuated indirectly, to release an excess pressure in the reservoir, in a controlled manner, prior to the complete removal of the cap from the reservoir.

BACKGROUND OF THE INVENTION

In the coolant reservoirs of radiators of engines of automotive vehicles or a power generator, a considerable buildup of abnormal pressure and temperature conditions is a common occurrence. Further, these vehicles have less engine surface to dissipate the heat into the atmosphere. Therefore, in order to contain such excessive heat build-up problem, pressurized cooling systems are adopted. The pressurized cooling systems include a radiator with a coolant reservoir or a surge tank. The reservoir is provided with an opening, which is covered with a sealing cap, to facilitate filling and removal of coolant into and from the reservoir. Pressurized reservoirs of radiators are often provided with a closure cap or a valve which, when removed, allows the tank to release pressure and be filled with refilling coolant.

Whenever, it is desired to remove the sealing cap from the radiator and when the coolant is at a high temperature and under pressure, greater caution and care must be exercised, in removing the sealing cap from the radiator. Unless such care is used, the pressurized hot coolant is likely to be suddenly discharged from the spout of the radiator thereby causing serious burns to a person removing the cap and bystanders. More particularly, the sudden discharge of hot coolant becomes more acute, if the sealing cap is removed in a rapid and hurried manner, resulting in possible ejection of the sealing cap from the snout as a projectile.

Presently, dual O-ring sealing cap is adopted for radiator/surge tank, which releases, the excessive pressure from the reservoir, while the dual O-ring sealing cap is uninstalled, manually, from the spout. However, in case the sealing cap is rapidly uninstalled, resulting in premature opening or ejection of the sealing cap, thereby causing accidental discharge of hot coolant from the reservoir of the radiator. In other words, in such known dual O-ring sealing caps, a controlled and gradual release of residual positive pressure, that is built up in the reservoir having a hot coolant, till the positive pressure inside the reservoir matches with outer atmospheric pressure, becomes a limiting factor, especially whenever the dual O-ring sealing caps are uninstalled rapidly.

In another known metallic sealing cap, a non-rotatable lever is arranged on the top surface of the cap, which is lifted vertically, by a user, directly, to release the excess pressure from the reservoir, before the cap is uninstalled from the spout. In such arrangement, in view of the limited availability of the surface area of the cap, a considerable effort is required on the part of the user to lift the lever, without exposing the user to the hotter surfaces of the radiator and engine systems of an automotive. In this known arrangement of metallic sealing caps, in order to prevent accidental rotation of the cap, a tab is provided, which is locked with the spout of the radiator.

U.S. Pat. No. 5,108,001 discloses a pressure relief and venting closure cap for a filler neck of a vehicle gas or coolant system tank having an initial rotary drive which opens a vent valve in response to a differential movement between a cap shell and a vent valve actuator to vent the filler neck. In this disclosure, the retainer is pushed downwards to open the sealed vent valve to release the pressure. In addition, a biasing spring is used to retain the cam in its original position.

It is therefore, highly advantageous to provide a pressure-release sealing cap, with a pressure-release member, which is operable indirectly by a user, to release the excess pressure, in controlled and regulated manner, from a reservoir of an automotive vehicle radiator, prior to the removal of the pressure-release sealing cap.

OBJECTS OF THE PRESENT INVENTION

The primary object of the present invention is to provide a pressure-release cap with a vertically movable and rotatable pressure-release member, which is actuated indirectly, to release excess pressure in a reservoir, reservoir of a radiator or a surge tank, of an automotive or a power generator, in a controlled manner.

An object of the present invention is to provide a pressure-release cap, which can be opened with a least effort, where the pressure-release member is lifted indirectly without exposing the user to the hotter surfaces of the radiator and engine systems of an automotive or a power generator.

Another object of the present invention is provide a pressure-release cap, with a pressure-release member, which is operable indirectly by a user, to release the excess pressure, in a controlled and regulated manner, from a reservoir of a radiator of an automotive vehicle or a power generator, prior to the uninstallation of the pressure-release cap.

Yet another object of the present invention is to provide a pressure-release cap with an enhanced pressure release flow path.

Other objects and advantages will be apparent to those skilled in the art from the following detailed description taken in conjunction with the appended claims and drawings.

SUMMARY OF THE INVENTION

The present invention provides a pressure-release sealing cap to close a reservoir of radiator or a surge tank, of an automotive or a power generator reservoir. The sealing cap includes a rotatable platform with a ramp connected to a rotatable enclosure. The ramp is a circular gradient with substantially flat first reference portion and a second reference portion with a highest gradient. A vertically movable and rotatable plunger is connected to a movable pressure-release member with a guide stud and a valve means. The guide stud disposed on the ramp between the first and second reference portions, while the sealing cap is installed on the reservoir. The guide stud is arranged to rotate on the ramp on rotation of the enclosure to lift the valve means and to release the excess pressure while the sealing cap is concurrently removed from the reservoir. The pressure-releasing member is actuated indirectly to release excess pressure from the reservoir, in a controlled and gradual manner.

DETAILED DESCRIPTION OF THE INVENTION

Figure 1:
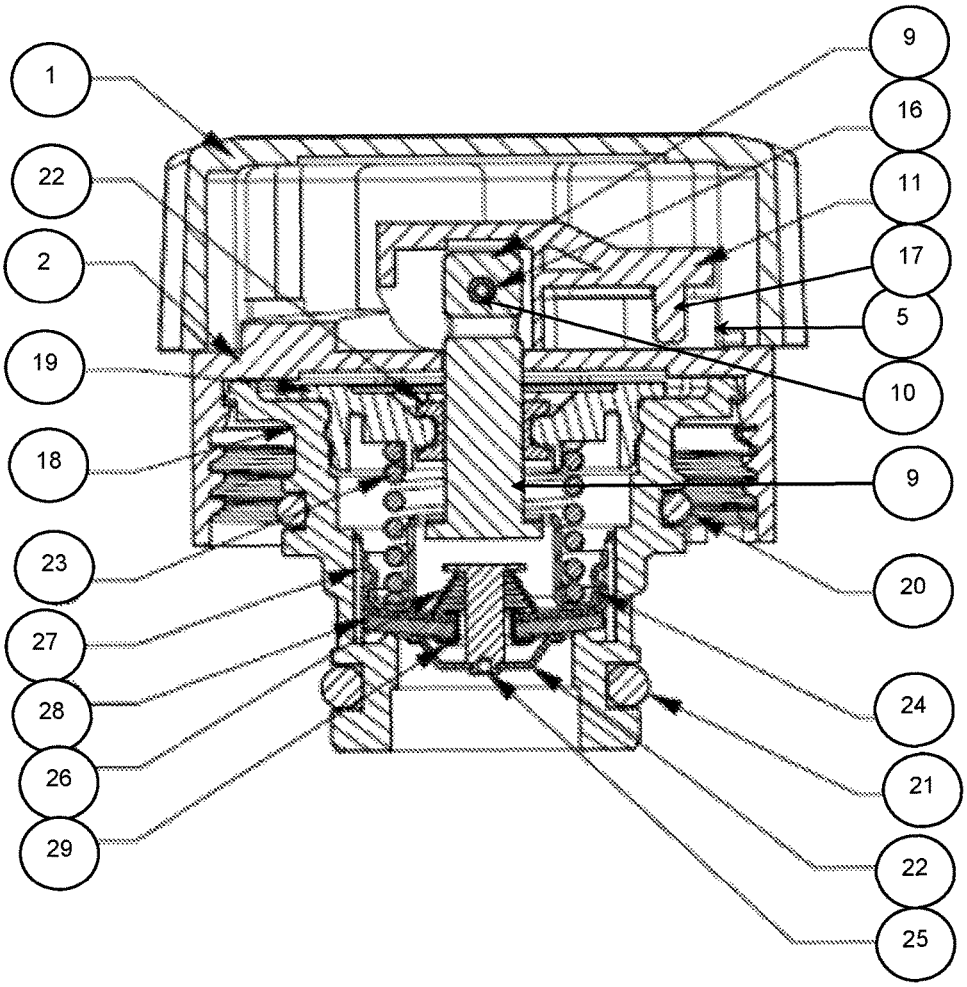
FIG. 1 is a cross-sectional view of pressure-release cap of the present invention depicting pressure-release member in normal position.

The pressure-release sealing cap of the present invention, as shown in FIG. 1 includes an enclosure 1 with suitable internal and outer profiles. The internal profile is of the enclosure 1 is hollow so as to accommodate a rotatable platform 2, inside the enclosure 1. The inner portion of the enclosure is provided with an arrangement of recesses with intervening gaps among them. The external profile of the enclosure 1 is advantageously shown as having a circular profile and is not intended to be limited to that profile. For instance, the profile of the enclosure 1 can be polygonal. The external profile of the enclosure 1 is provided with extrusions to facilitate gripping of the enclosure 1, by a user during installation and removal of the cap. The enclosure 1 also acts as a top cover for the cap. The material for the enclosure 1 is preferably nylon and other thermoplastic materials can be suitably adapted for use.

Figure 2:
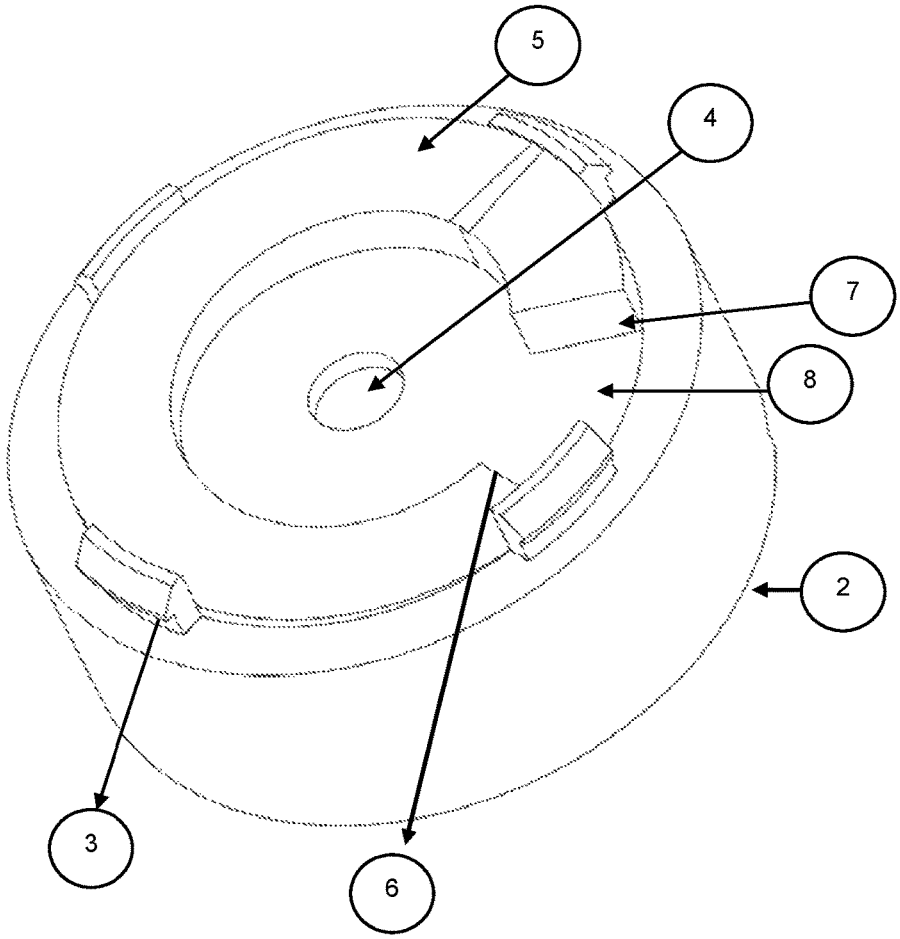
FIG. 2 is a perspective top view of the pressure-release cap of the present invention depicting a circular guide.

Now, by referring to FIG. 2, in addition to FIG. 1, of the accompanying drawings, the features of the rotatable platform 2 of the pressure-release sealing cap, which is enclosed in the enclosure 1, are now described. The rotatable platform 2 is provided with a matching profile (circular profile) of the enclosure 1 and is arranged in the enclosure 1. An intervening space between the rotatable platform 2 and the enclosure 1 is provided. The upper surface of the rotatable platform 2 is provided with a plurality of locking latches or protrusions 3. The locking latches 3 are arranged on the rotatable platform 2 with intervening spaces among them. The locking latches 3 are provided with suitable surface profiles, preferably, in the form of ratchets, which are arranged to enter the recesses of the enclosure 1 and engage with them. In this exemplary aspect the rotatable platform 2 is connected to the enclosure 1 by executing a locking arrangement of the locking latches 3 with the recesses of the enclosure 1. The locking arrangement between the rotatable platform 2, enables a reciprocal rotation of the rotatable platform 2 along with the rotation of the enclosure 1. It is understood here that the rotatable platform 2 can also be rotatably connected to the enclosure 1, through other locking means such as press-fit, interference fit or a snap fit arrangements, to effect reciprocal rotary motions of the enclosure 1 and rotatable platform 2. The material for the enclosure 1 is preferably nylon and other thermoplastic materials can be suitably adapted for use. The inner portion of the rotatable platform 2 is defined by a threaded profile so as to integrate with the threaded profile of filler neck or spout of the reservoir. The rotatable platform 2 is used to seal the opening of the spout of the reservoir. The rotatable platform 2 is provided with a central opening 4 to facilitate the passage of a plunger as hereinafter described.

A ramp 5 is arranged on the top surface of the rotatable platform 2. The ramp 5 is a circumferential gradient commencing with a lowest gradient at a first reference portion 6, which is substantially levelled to the top surface of the rotatable platform 2 and extending as a circumferential gradient along the surface of the rotatable platform 2 and terminating at a second reference portion 7 with a highest gradient.

The height of the gradient of the ramp 5 is determined based on the extent of vertical travel that is to be performed by a plunger of the pressure-release sealing cap, in order to release the excess pressure that is built up in the reservoir, in a gradual and regulated manner. In other words, the height of the gradient of the ramp 5 is determined so as ensure the complete elimination of the residual positive pressure prevailing inside the reservoir prior to the removal of the cap. The gradient is suitably implemented so that the removal of the cap is gradual and at the same time valve arrangement is gradually and currently opened to release the pressure from the reservoir. Therefore, the rotary movement of the cap during its removal concurrently facilitates the elimination of the excess pressure from the reservoir.

An intervening space 8 is arranged between the first and second reference portions 6 and 7 of the ramp 5. The intervening space 8 acts as a parking area for movable pressure release member at the time of the installation of the cap, so as to ensure a complete sealing of the cap to the reservoir.

The ramp 5 is integrally and permanently fixed to the rotatable platform 2. The integral connectivity of the ramp 5 to the rotatable platform can be by means of a molding or adhesion. Alternately, the ramp 5 can also be detachably connected to the rotatable platform 2.

The ramp 5 as particularly shown in FIG. 2 is a single structure, which can be made from suitable metals such as stainless steel, steel alloy, aluminum, brass, composite metals, alloys of metals, polymer, preferably a heat and wear-resistant polymer. The surface of the ramp 5 can also suitably coated with an abrasion resistant coating.

Alternately, a multi-layered the ramp can also be provided with each layer demonstrating variable wear-resistant properties, with the top layer provided with an abrasion resistant coating and other layers with graded wear-resistant materials. In case of a multi-layered ramp a suitable supporting and/or cushioning arrangement can be provided between or among the layers of the multi-layered ramp.

A movable plunger 9 is permitted to pass through the central opening 4 of the rotatable platform 2 and arranged to possess lifting movement along the vertical axis of the plunger 9. The movable plunger 9 is also provided with a rotary movement along its vertical axis. A pin hole 10 is provided at the proximal end of the movable plunger 9 and a valve means, as hereinafter described, is connected to the distal end of the plunger 9, as shown in FIG. 1. The vertical movement of the plunger 9 facilitates the closing and releasing the valve means.

Figure 3:
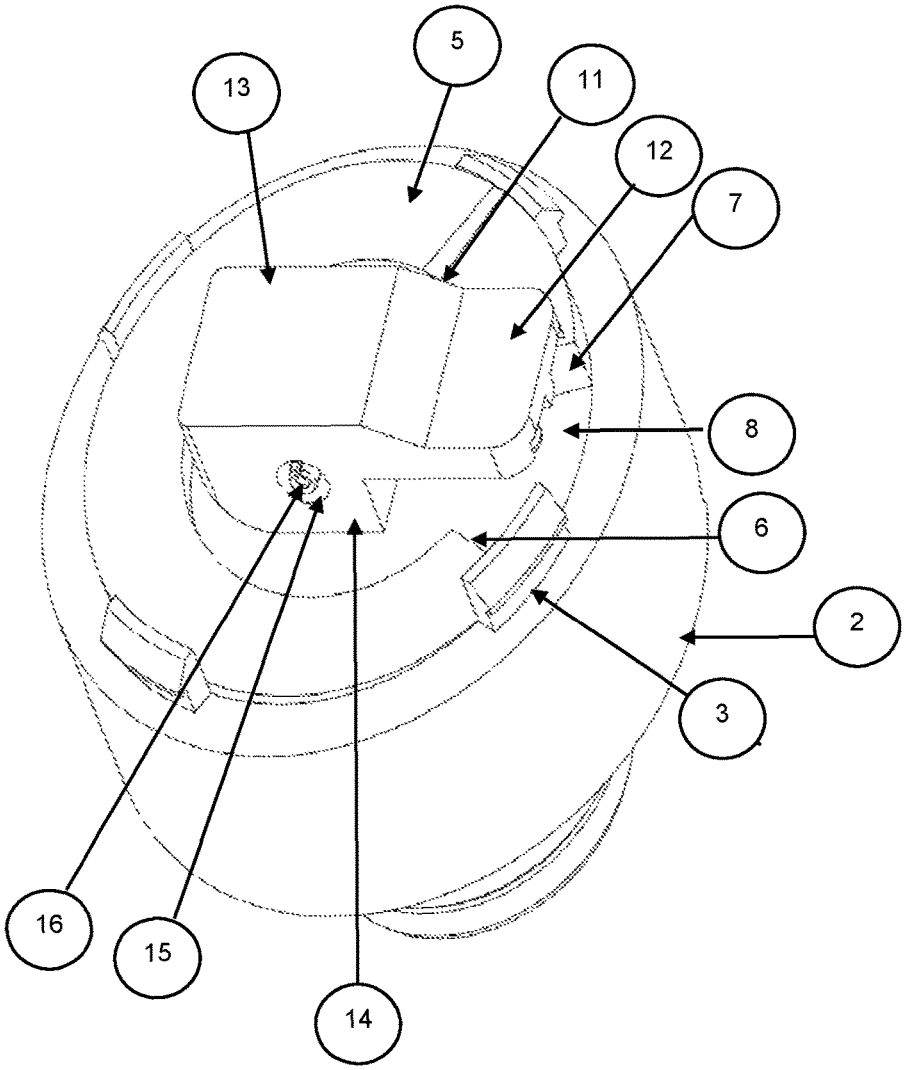
FIG. 3 is a perspective top view of the pressure-release cap of the present invention depicting a pressure-release member positioned in proximity to the circular guide.

As shown in FIG. 1 and FIG. 3, a movable pressure-release member 11 is mounted on the rotatable platform 2. The pressure-release member 11 is advantageously provided with an elongated structure having a flat portion 12 and a hollow thicker portion 13. The hollow thicker portion 13 is provided with side walls 14 having openings 15 and the side walls 14 are separable by an intervening space. Alternately, the hollow thicker portion 13 can be a solid block with an intervening passage between the side walls 14.

A rivet 16 is arranged to pass through the openings 15. The movable plunger 9 is connected to the pressure-release member 11 through the pin hole 10 and the rivet 16. The pressure-release member 11 hinges on the rivet 16 and the rivet 16 acts as a fulcrum or a pivot point about which the vertical and rotary movements of the pressure-release member 13 are performed.

In the present invention the pressure-release member 11 is exemplarily shown as a lever. However, other suitable devices such as a handle, ring etc., can be suitable adapted for use.

A guide stud 17 is connected to the inner surface of the pressure-release member 11, and preferably at the flat portion 12. The guide stud 17 can also arranged at the far end of the flat portion 12. The guide stud 17 is made of either a hard material or a flexible material. The guide stud 17 is made of a metal, a metal alloy or a polymer. The guide stud 17 is provided with a smooth end so that it can glide easily on the rotatable platform 2.

The movable pressure-release member 11 is connected to the movable plunger 9, in such a manner the guide stud 20 rests on the intervening space 8 of rotatable platform 2 and in between the first and second reference portions 6 and 7, at the time of installation of the cap, so that the cap is completely sealed to the reservoir.

An intervening space is provided between the upper surface of the rotatable platform 2 and the inner surface of the enclosure 1, so as to facilitate the rotation and lifting of the movable pressure-release member 11. The movable pressure-release member 11 rotates along the pre-defined elevated path of the ramp 4 along with the guide stud 17.

It is also within the purview of this invention where the movable pressure-release member 11 that is connected to the movable plunger 9 can also be arranged to lift upwards from the top surface of the enclosure 1, through a window or opening arranged on the rotatable platform 2.

The main valve means or arrangement is incorporated in a valve housing 18 and covered with a lid 19. The outer surface of the valve housing 18 is provided with suitable profiles to accommodate dual O-rings 20 and 21, of different sizes and diameters. The O-rings are used on the surface of the valve housing 18 to prevent leakage from the filler neck or spout of the reservoir.

The main valve arrangement is arranged about the movable plunger 9 and includes a rubber bush 22, a main valve spring 23 and a retainer 24. The main valve spring 23 is mounted around the movable plunger 9 and its one end biasingly abutted to the retainer 24. The main valve spring 23 helps in building the system pressure and once the system pressure exceeds a pre-determined limit the valve spring 23 gets compressed thereby opening the main valve to vent the system pressure. Thereafter, once the system pressure drops the valve spring 23 retains to its original position.

A movable vacuum valve rivet 25 is fastened to a retainer protector 22 at one end and connected to vacuum valve spring 26 at other end. The movable vacuum valve rivet 25 passes through a gasket retainer cover 27. The retainer cover 27, which is a hollow member having a central opening, is mounted on the protector gasket 28, so that the bottom surface of the retainer cover abuts the top surface of the protector gasket 28. The retainer protector 22 is present below the protector gasket 28, which is in contact with the vacuum valve rivet 25. The retainer protector 22 has a sealing bead, which remains in contact with the gasket 28 attached to the retainer cover 27. The retainer 24, which is positioned inside the valve housing 18, is directly abutted to the retainer cover 27. The main valve spring 23 rests on the depressed side of the retainer 24, which in turn is mounted on the movable plunger 9. The eyelet 29 holds the retainer cover 27 and the gasket 28 together and has an aperture for the vacuum valve rivet 25 to pass through. The retainer cover 27 has a convex dome shaped profile with an aperture at its centre. The vacuum valve spring 26 is held in between the vacuum valve rivet 25 and the retainer 24. The vacuum valve spring 26 compresses when the vacuum inside the system reaches below the atmospheric pressure thereby opening the vacuum valve.

The movable pressure-release member 11 is configured to rotate, while being rotated it is also configured to lift vertically, in gradual manner, along with the rotation of the rotatable platform 2, while uninstalling the pressure-release cap, thereby concurrently lifting the movable plunger 9.

Figure 4:
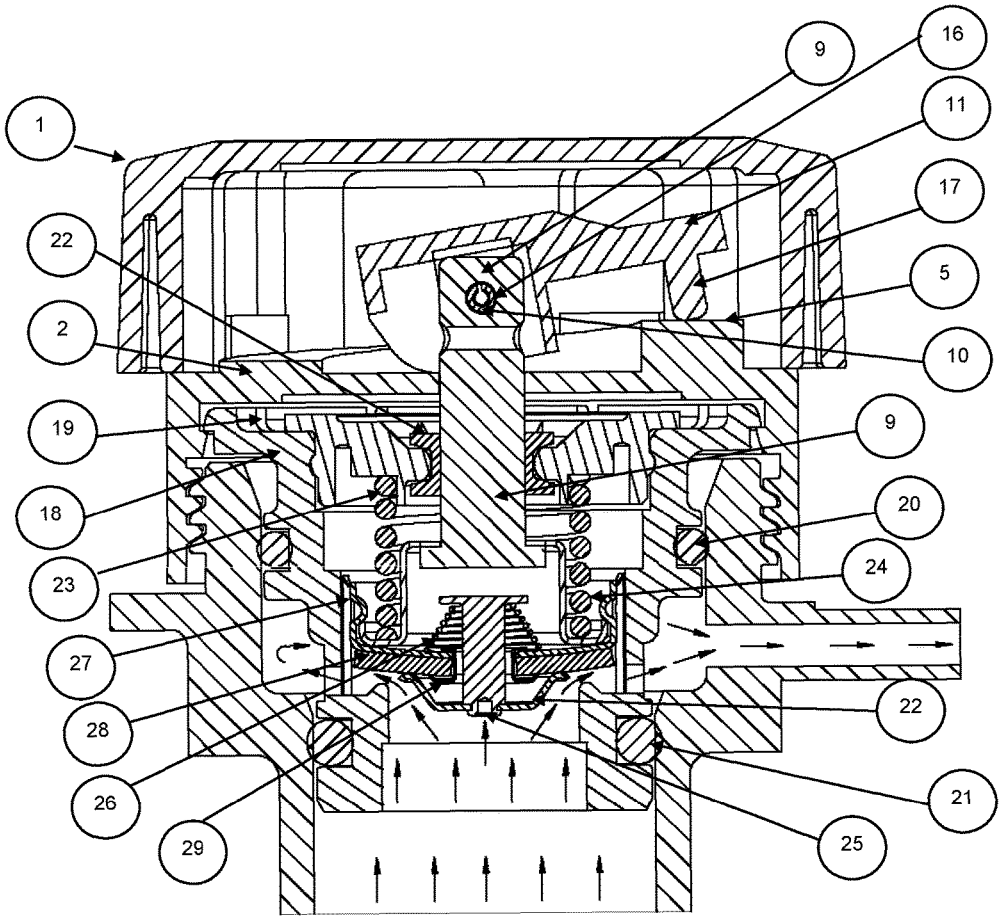
FIG. 4 is a cross-sectional view of pressure-release sealing cap of the present disclosure depicting pressure-release member in pressure-released position.

Now, referring to FIG. 4, the controlled and regulated release of the abnormal pressure that is built up in the reservoir, by the pressure-release sealing cap of the present invention, through an enhanced pressure flow path, is described. The pressure-release sealing cap is installed on the reservoir of a radiator, by screwing the cap on to the filler neck of the reservoir. During this process, the guide stud 17 is positioned on the intervening space 8, so that the sealing cap seals the reservoir completely. Whenever, the cap is required to be removed from the filler neck of the reservoir, the cap is unscrewed and corresponding rotary motion of the enclosure 1 actuates rotary motion of the rotatable platform 2 and the movable pressure-release member 11 along with the guide stud 17. In other words, the guide stud 17 gets displaced from its parking space 8 and travels along the ramp.

The height of the gradient of the ramp 5 is determined based on the extent of vertical travel that is to be performed by a plunger of the pressure-release sealing cap, in order to release the excess pressure that is built up in the reservoir, in a gradual and regulated manner. In other words, the height of the gradient of the ramp 5 is determined so as ensure the complete elimination of the residual positive pressure prevailing inside the reservoir prior to the removal of the cap. The gradient is suitably implemented so that the removal of the cap is gradual and at the same time valve arrangement is gradually and currently opened to release the pressure from the reservoir. Therefore, the rotary movement of the cap during its removal concurrently facilitates the elimination of the excess pressure from the reservoir. Once the pressure-release sealing cap is rotated with the desirable number of rotations, the movable plunger 9 is lifted vertically with gradual lifting. The lifting of the movable plunger 9 is performed without directly lifting the pressure-release member 11 manually by the user. The lifting of the movable plunger 9 enables the lifting of the valve arrangement of the pressure-release cap to release the positive pressure that is built up in the reservoir, as shown in FIG. 4. Concurrently, the release of the excess or positive pressure is also performed through the perforations of valve housing 18 by the movement of the dual O-rings. In other words, in the pressure-release safety cap of the present invention a rotary drive is provided to release the internal pressure. The release of pressure and removal of the cap is performed simultaneously. The lifting of the pressure-release member 11 is performed till the completion of the removal of the pressure-release sealing cap. In this manner, by adopting the movable pressure-release member 11 of the present invention, the pressure inside the reservoir is equalized with the outer atmospheric pressure, in a gradual and controlled manner, before the pressure-release cap is eventually removed from the reservoir.

Figure 5:
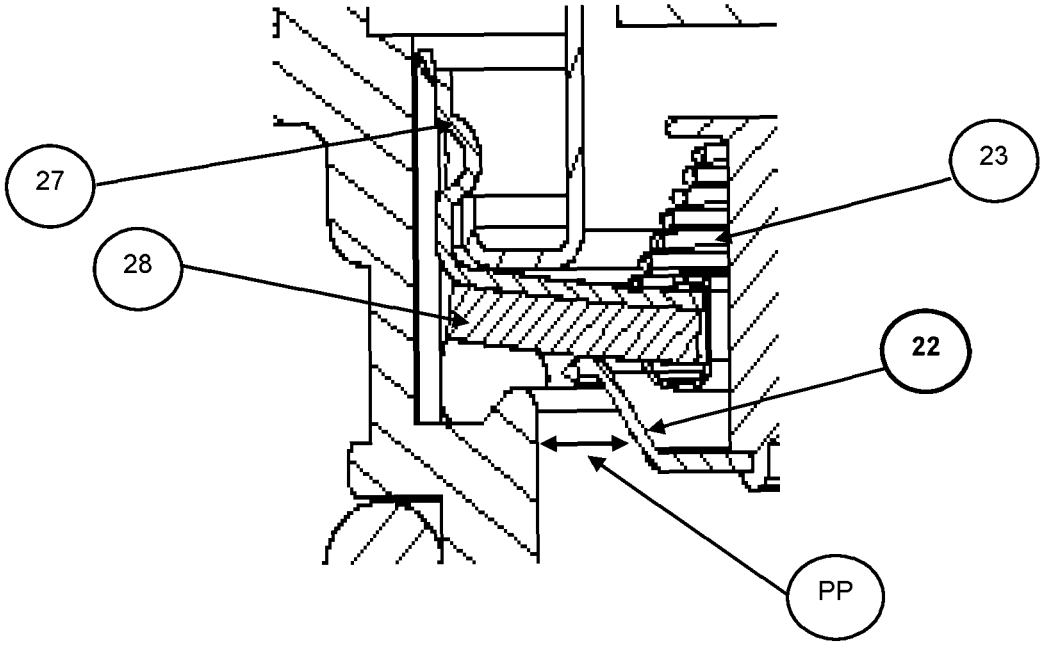
FIG. 5 is a partial magnified cross-sectional view of pressure-release cap of the present invention depicting an increased pressure release flow path area.

Now, by referring to FIG. 5, the embodiments pertaining to the enhanced pressure flow path (PP) of pressure-release sealing cap are described. In the pressure-release sealing 25 cap of the present invention no separate spring is used to retain the movable pressure release member 11 to the original or its resting position, since the movable pressure release member 11 is retained by means of the main valve spring 23.

In the foregoing embodiments, the pressure-release cap is shown with enclosure 1. However, it is within the purview of this invention where the pressure-release cap can also be implemented without having the enclosure 1.

Advantages

By using the pressure-release cap of the present invention the presence of residual positive pressure in the reservoir is completely eliminated before the cap is removed. The operation of the pressure-release member is indirect, which requires a substantially lesser effort from the user.

In view of the equalization of the inner pressure of the reservoir with the external atmospheric pressure, before the pressure-release cap is removed, even under rapid conditions, the risk of forcible ejection of the cap and spillage of hot liquid is prevented.

During installation of the pressure-release cap the pressure-release member is positioned at a desirable position on the ramp so that the sealing of the valve arrangement is accomplished.

We claim:

1. A pressure-release sealing cap for a reservoir, comprising:

a rotatable platform with a central opening, operably connected to a hollow and rotatable enclosure, with an intervening space between said enclosure and said rotatable platform;

a ramp disposed on said rotatable platform, said ramp including a first and second reference portions with said intervening space between said first and second reference portions;

a movable plunger with a proximal end and a distal end, disposed through said central opening, said distal end connected to a valve, said plunger disposed to lift said valve;

a movable pressure-release member with a guide stud, the movable pressure-release member pivoted to the proximal end of said plunger and said guide stud disposed on said ramp between said first and second reference portions, while said sealing cap is installed on said reservoir; and said movable pressure-release member along with said guide stud disposed to rotate on said ramp on rotation of said enclosure and said rotatable platform to lift said valve through said plunger, while removing said sealing cap from said reservoir.

2. The cap as claimed in claim 1, wherein a plurality of latches are disposed on said rotatable platform and corresponding recesses in said enclosure to operably engage said plurality of latches to connect said rotatable platform to said rotatable enclosure.

3. The cap as claimed in claim 1, wherein said first reference portion of said ramp is substantially leveled to a surface of said rotatable platform.

4. The cap as claimed in claim 1, wherein said ramp between said first and second reference portions is with a circumferential gradient.

5. The cap as claimed in claim 1, wherein said ramp is made of a metal, a metal alloy or a polymer.

6. The cap as claimed in claim 1, wherein said movable pressure-release member is a lever.

7. The pressure-release cap as claimed in claim 1, wherein said guide stud is made of a metal, a metal alloy or a polymer.

8. The cap as claimed in claim 1, wherein said cap is without said enclosure.

* * * * *